US006736532B2

(12) United States Patent
Crawley et al.

(10) Patent No.: US 6,736,532 B2
(45) Date of Patent: May 18, 2004

(54) HEADLIGHT ASSEMBLY

(75) Inventors: Richard Lee Crawley, Ann Arbor, MI (US); Lawrence Francsis Wilski, Macomb Township, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/107,701

(22) Filed: Mar. 27, 2002

(65) Prior Publication Data

US 2003/0185016 A1 Oct. 2, 2003

(51) Int. Cl.[7] ..... F21V 7/22
(52) U.S. Cl. ..... 362/516; 362/296; 362/341
(58) Field of Search ..... 362/296, 341, 362/516, 347

(56) References Cited

U.S. PATENT DOCUMENTS

| | | | | |
|---|---|---|---|---|
| 2,699,402 A | * | 1/1955 | Meyer | 428/416 |
| 4,085,248 A | | 4/1978 | Zehender et al. | 428/336 |
| 5,003,447 A | | 3/1991 | James et al. | 362/516 |
| 5,234,729 A | | 8/1993 | Wheatley et al. | 428/30 |
| 5,298,290 A | | 3/1994 | Jost et al. | 427/489 |
| 5,405,448 A | | 4/1995 | Jost et al. | 118/723 E |
| 5,750,747 A | * | 5/1998 | Furutani et al. | 554/36 |
| 5,985,465 A | | 11/1999 | Daichou et al. | 428/458 |
| 6,007,875 A | | 12/1999 | Grunwald et al. | 427/489 |
| 6,488,394 B1 | * | 12/2002 | Mabe et al. | 362/510 |
| 6,520,650 B2 | * | 2/2003 | Fraizer | 362/341 |

FOREIGN PATENT DOCUMENTS

| | | |
|---|---|---|
| CA | 2294658 A1 | 1/2000 |
| GB | 2356827 A | 6/2001 |

* cited by examiner

*Primary Examiner*—Alan Cariaso
(74) *Attorney, Agent, or Firm*—Brinks Hofer Gilson & Lione

(57) ABSTRACT

The present invention is generally directed towards a headlight assembly installed in a motor vehicle. The headlight assembly includes a reflector member, and a light source. The reflector member is coated with a first layer of a highly reflective material to reflect the light emitted by the light source. In order to protect the first layer from oxidation, a second layer of an organic carbon compound free of electronegative compound is deposited on top of the first layer.

16 Claims, 2 Drawing Sheets

HEADLIGHT ASSEMBLY

TECHNICAL FIELD

This invention relates to lighting systems in automobiles. More specifically, this invention relates to a barrier coating on top of the metallized reflector in a headlight assembly in automobiles.

BACKGROUND

Conventionally, motor vehicles have either one or two pairs of headlights that perform the function of illuminating drivers filed of vision. In order to reflect the light, the headlights are provided with a headlamp reflector. The headlamp reflector is coated with a reflective metallic coating. However, in order to protect the reflective coating of the reflector, protective coatings have been coated on top of such reflective coating. Typically, the protective coating is hexamethyl di-siloxane (HMDSO) applied directly on top of the reflective coating by plasma polymerization in the same chamber used for metallization of the reflective coating. Although the process used to apply the protective coating is suitable for applying the coating at high rate, it has a number of disadvantages.

One of the major disadvantages of the HMDSO protective coating is that the low surface energy of the HMDSO can tend to cause a fogging appearance of the reflective layer due to air humidity and/or vapors from the headlights components. Another disadvantage of the HMDSO protective coating is that oxygen from the coating can oxidize the reflective metallization. In particular, experiments have shown that the oxygen attacks the copper in copper/aluminum gold colored reflective coatings, turning the color dark and also resulting in loss of reflectivity.

Other prior art have devised a method of coating the reflective layer with HMDSO and further coating the HMDSO layer with a hydrophilic layer. However, this method of first coating the reflective surface with HMDSO and then with a hydrophilic layer increases the processing time and also the cost of production, and does not prevent oxidation of the metallic reflective coating.

Therefore, there is a need in the industry to provide a better barrier coating on the reflective surface to prevent the fogging and the oxidation process described above. Also, there is a need in the industry to apply such barrier coating in a single process.

SUMMARY

In accordance with the preferred embodiment of the present invention, a headlight assembly installed in a motor vehicle has a transparent barrier coating deposited directly on top of the reflective metallic coating. Preferably, the headlight assembly is provided with a reflector and a light source. The interior surface of the reflector is first coated with a reflective layer. A second layer of a barrier coating is deposited on top of the reflective coating by the process of plasma polymerization. The material used as the barrier coating is an organic carbon compound that is free of any electronegative group such as oxygen.

In another aspect of the invention a method of coating an interior surface of a headlight assembly installed in a motor vehicle is disclosed. The method comprises the steps of depositing a first layer of a highly reflective material and depositing a second layer on top of the first layer of an organic carbon compound by the plasma polymerization process.

Further aspects, features and advantages of the present invention will become apparent from consideration of the following description and appended claims when taken in connection with the accompanying drawings.

DETAILED DESCRIPTION OF THE PREFERRED EMBODIMENT

The following description of the preferred embodiment is merely exemplary in nature and is in no way intended to limit the invention or its application or uses.

Figure 1:
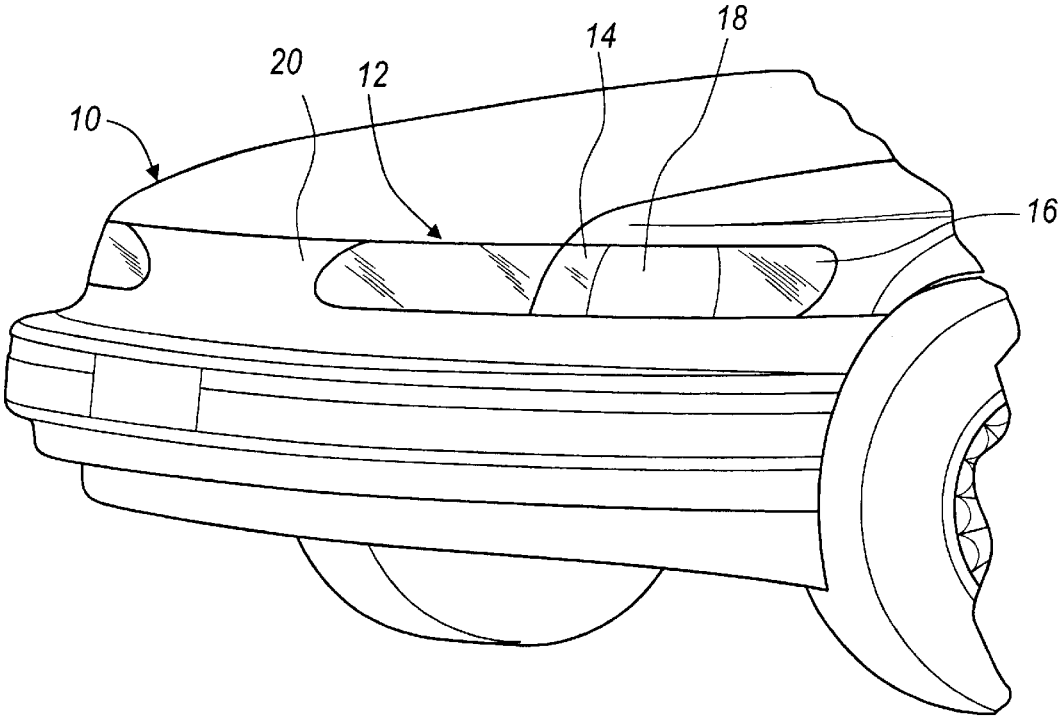
FIG. 1 is a front view of a motor vehicle incorporating the headlight assembly of the present invention.

Referring in particular to FIG. 1, a motor vehicle having the headlight assembly of the present invention is generally shown and designated by reference numeral 10.

As shown in FIG. 1, the motor vehicle 10 includes a headlight assembly 12, a turn signal 14, a cornering lamp 16 and a retro reflector 18. As shown in FIG. 1, the headlight assembly 12 is installed in the front of the motor vehicle. The headlight assembly 12 is used to illuminate a horizontal planar surface (not shown) in front of the motor vehicle 10. Further, the headlight assembly 12 is housed in a housing 20 that is connected to the motor vehicle 10.

Figure 2:
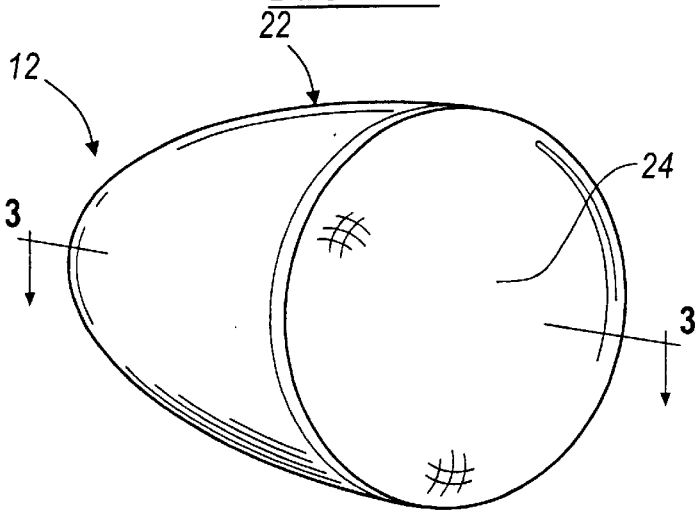
FIG. 2 is a side view of the headlight assembly in accordance with the teachings of the present invention.
Figure 3:
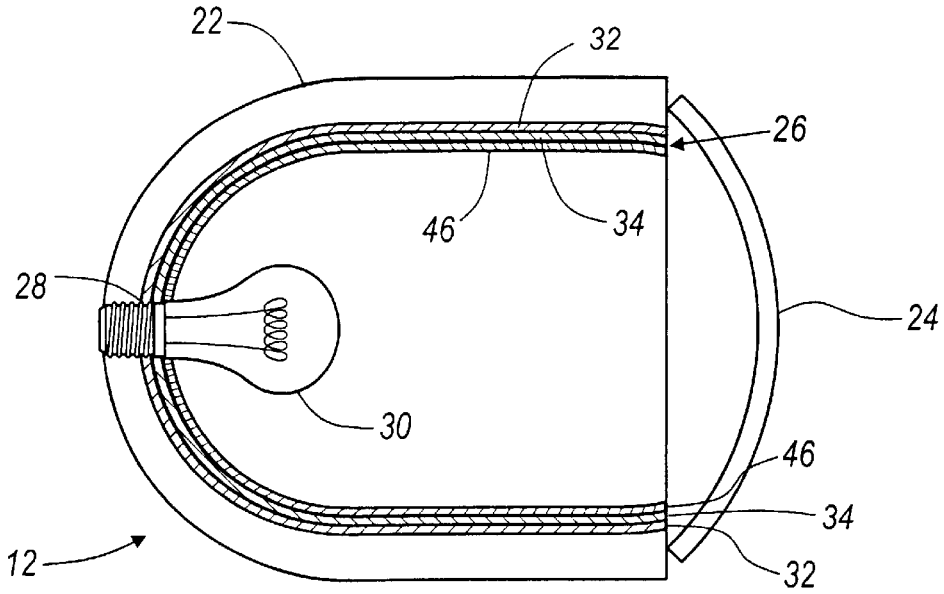
FIG. 3 is a cross sectional view through lines 3—3 in FIG. 2 of the headlight assembly in accordance with the teachings of the present invention.

Referring in particular to FIGS. 2 and 3, the headlamp assembly 12 includes a reflector member 22 the open end of which is adapted to be closed by a lens 24. The lens 24 is a colorless glass or plastic. Preferably, the reflector member 22 is metallic compound, a plastic compound or any other suitable material. The contour of the reflector member 22 yields the contour of the headlight assembly 12 and is therefore preferably configured in a contour, which is aesthetically pleasing and complimentary to the location on the motor vehicle 10. The reflector member 22 is preferably polycarbonate, nylon, ABS (Acrylonitrile-butadiene-styrene copolymer), BMC (Bulk Molding Compound, a polyester based thermoset) or polyetherimide or the like.

With continued reference to FIGS. 2 and 3, the reflector member 22 includes an interior surface 26 that is parabolic in shape. The reflector member 22 also defines a cavity portion 28 for supporting a light source 30, such as a bulb (as shown in FIG. 3). The light source 30 provides a light beam (not shown). A portion of the light beam from the light source 30 strikes the interior surface 26 before exiting the lens 24. In addition, a portion of the light beam exits the lens 24 without striking the interior surface 26.

Referring in particular to FIG. 3, in order to increase the reflectivity, the interior surface 26 of the reflector member 22 is coated with a first reflective layer 32. To protect the reflective layer 32 from oxidation, a second barrier layer 34 is coated on top of the reflective layer 32. The first reflective layer 32 is formed of a highly reflective material to increase the reflectivity of the reflector member 22. Preferably, the reflective material is either aluminum, copper or a copper/aluminum mixture. Alternatively, other reflective materials such as silver, zinc and other materials may be used to form the first reflective layer 32. The first reflective layer 32 is deposited on the interior surface 26 of the reflector member 22 by means of electroplating, or vacuum deposition such as evaporation or sputter deposition processes. These processes are well known in the art and are not explained in detail. Alternatively, the first reflective layer 32 can be deposited on the interior surface 26 using other process such as vapor deposition process or thermal spray process.

In order to prevent delamination or oxidation of the first reflective layer 32, the interior surface 26 of the reflector member 22 is coated with a second barrier layer 34 on top of the first reflective layer 32. The second barrier layer 34 is formed of a carbon compound, preferably an organic carbon compound. Preferably, the carbon compound is an open-chain or cyclic alkenes, alkynes or aromatics. Preferably, the carbon compound is trans-2-butene, butadiene, acetylene or octadiyne. Alternatively, any carbon compound free of any electronegative functional group capable of forming polymers on the first reflective layer 32 may be selected. It is preferred that the carbon compound selected is free from oxygen.

Figure 4:
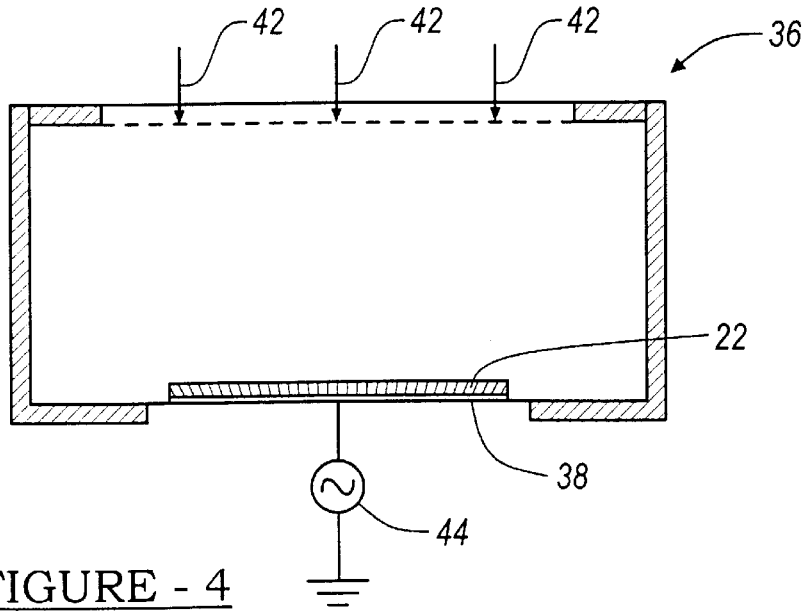
FIG. 4 is a cross sectional view of the plasma reactor use for plasma polymerization in accordance with the teachings of the present invention.

Referring in particular to FIG. 4, in order to deposit the second barrier layer 34 on top of the first reflective layer 32, plasma polymerization process is used. Plasma polymerization is a process, in which gaseous monomers are converted to a plasma state and condense on freely selectable substrates, in this case the interior surface 26 of the reflector member 22. The plasma polymerization deposition of the second barrier layer 34 is carried out in a vacuum chamber 36. The vacuum chamber 36 comprises an electrode 38, referred to as the cathode. The suitable carbon compound for example, trans-2-butene, or butadiene is converted from a liquid state to a gaseous state by an evaporator (not shown). The gaseous trans-2-butene or butadiene is then introduced into the vacuum chamber 36. The introduction of the gaseous form of trans-2-butene, butadiene is shown by arrows 42. Power is applied to the electrode 38 by a suitable power source 44. A suitable power source 44 may be a-c, r-f, or microwave electrical energy. One terminal of the power source 44 is connected to the electrode 38 and the other terminal is grounded.

When the gaseous form of trans-2-butene, butadiene is introduced into the vacuum chamber 36 and suitable power is applied across to the electrode 38, the excited electrons initiate polymerization by ionizing the trans-2-butene or butadiene molecules. Under suitable electrical power the trans-2-butene or butadiene molecules break apart creating free electrons, ions, excited molecules and radicals. As is well known the electrode 38 becomes negatively biased with respect to the plasma and facilitates the deposition of the plasma on the interior surface 26 of the reflector member 22, thereby forming the second barrier layer 34 on top of the first reflective layer 32.

In order to further protect the first reflective layer 32, the reflector member 22 may also comprise a third protective layer 46. The third protective layer 46 is deposited on top of the second barrier layer 34. The third protective layer 46 is formed of an organic silicon compound such as hexa-methyl di-siloxane (HMDSO). The third protective layer 46 can be deposited on top of the second barrier layer 34 by the plasma polymerization process. The presence of the third protective layer 46 on top of the second barrier layer 34 will protect the first reflective layer 32 from environmental elements.

As seen from the above, in accordance with the teachings of the present invention, the interior surface 26 of the reflector member 22 comprises a first reflective layer 32, a second barrier layer 34 deposited by plasma polymerization process on top of the first reflective layer 32 and optionally a third protective layer 46 on top of the second barrier layer 34. The headlight assembly of the present invention exhibits substantially better reflective properties due to the reduced oxidation of the reflector member 22.

As any person skilled in the art will recognize from the previous description and from the figures and claims, modifications and changes can be made to the preferred embodiment of the invention without departing from the scope of the invention as defined in the following claims.

What is claimed is:

1. A headlight assembly installed in a motor vehicle, the headlight assembly comprising:

a light source to emit a light beam; and a reflector surrounding the light source to reflect the light beam emitted from the light source, the reflector having an interior surface, wherein the interior surface comprises:

a first layer of reflective coating deposited on the interior surface of the reflector;

a second layer of a barrier coating deposited on the first layer wherein the second layer is deposited on the first layer by plasma polymerization of an organic carbon compound wherein the organic carbon compound is free of an electronegative group; and a third layer of a protective coating on said second layer wherein the third layer comprises an organic silicon compound.

2. The headlight assembly of claim 1, wherein the organic silicon compound is hexa-methyl di-siloxane.

3. The headlight assembly of claim 1, wherein the first layer is deposited on the interior surface of the reflector by a sputtering deposition process.

4. The headlight assembly of claim 1, wherein the reflective coating is a metallic material selected from a group consisting of aluminum, copper and a combination thereof.

5. The headlight assembly of claim 1, wherein the organic carbon compound is selected from a group consisting of open chain alkanes, open chain alkynes, open chain aromatics, cyclic alkanes, cyclic alkynes and cyclic aromatics.

6. The headlight assembly of claim 5, wherein the organic carbon compound is free of oxygen.

7. The headlight assembly of claim 1, wherein the organic carbon compound is selected from a group consisting of trans-2-butene, butadiene, acetylene and octadiyne.

8. A headlight assembly comprising:

a light source to emit a light beam; and a reflector surrounding the light source to reflect the light beam emitted from the light source, the reflector having an interior surface, wherein the interior surface comprises:

a first layer of reflective coating deposited on the interior surface of the reflector; and a second layer of a barrier coating deposited on the first layer, wherein the second layer is deposited on the first layer by plasma polymerization of an organic carbon compound, the organic carbon compound being free of an electronegative group.

9. The headlight assembly of claim 8, further comprising a third layer of a protective coating on the second layer wherein the third layer comprises an organic silicon compound, the organic carbon compound being free of an electronegative electronegative group.

10. The headlight assembly of claim 9, wherein the organic silicon compound is hexa-methyl di-siloxane.

11. The headlight assembly of claim 8, wherein the first layer is deposited on the interior surface of the reflector by a sputtering deposition process.

12. The headlight assembly of claim 8, wherein the reflective coating is a metallic material selected from a group consisting of aluminum, copper and a combination thereof.

13. The headlight assembly of claim 8, wherein the organic carbon compound is free of an electronegative group.

14. The headlight assembly of claim 8, wherein the organic carbon compound is free of oxygen.

15. The headlight assembly of claim 8, wherein the organic carbon compound is selected from a group consisting of open chain alkanes, open chain alkynes, open chain aromatics, cyclic alkanes, cyclic alkynes and cyclic aromatics.

16. The headlight assembly of claim 8, wherein the organic carbon compound is selected from a group consisting of trans-2-butene, butadiene, acetylene and octadiyne.

* * * * *

UNITED STATES PATENT AND TRADEMARK OFFICE

CERTIFICATE OF CORRECTION

PATENT NO. : 6,736,532 B2
DATED : May 18, 2004
INVENTOR(S) : Richard Lee Crawley et al.

It is certified that error appears in the above-identified patent and that said Letters Patent is hereby corrected as shown below:

Column 4,
Line 67, delete "electronegative" (second occurrence).

Signed and Sealed this

Thirty-first Day of August, 2004

JON W. DUDAS
*Director of the United States Patent and Trademark Office*